US005884496A

United States Patent [19]

Kim et al.

[11] Patent Number: 5,884,496

[45] Date of Patent: Mar. 23, 1999

[54] COOL AIR FEEDING SYSTEM FOR REFRIGERATOR

[75] Inventors: Hyun Jong Kim, Changwon-si; Jae Jin Kim, Pusan-si; Young Chul Son, Masan-si, all of Rep. of Korea

[73] Assignee: LG Electronics, Inc., Seoul, Rep. of Korea

[21] Appl. No.: 753,301

[22] Filed: Nov. 22, 1996

[30] Foreign Application Priority Data

| | | | |
|---|---|---|---|
| Nov. 25, 1995 | [KR] | Rep. of Korea | 35749/1995 |
| Dec. 27, 1995 | [KR] | Rep. of Korea | 58917/1995 |
| Dec. 28, 1995 | [KR] | Rep. of Korea | 50275/1995 |

[51] Int. Cl.[6] ..... F25D 17/04

[52] U.S. Cl. ..... 62/186; 62/441; 62/408

[58] Field of Search ..... 62/208, 187, 407, 62/441, 186, 408

[56] References Cited

U.S. PATENT DOCUMENTS

| | | | |
|---|---|---|---|
| 3,027,732 | 4/1962 | Mann et al. | 62/187 |
| 4,304,101 | 12/1981 | Gidseg | 62/187 |
| 4,704,874 | 11/1987 | Thompson et al. | 62/408 X |
| 4,876,860 | 10/1989 | Negishi | 62/186 X |
| 5,664,437 | 9/1997 | Park et al. | 62/407 |
| 5,675,981 | 10/1997 | Lee | 62/187 |

FOREIGN PATENT DOCUMENTS

| | | |
|---|---|---|
| 90-8735 | 5/1990 | Rep. of Korea . |
| 94-821 | 1/1994 | Rep. of Korea . |

*Primary Examiner*—Henry Bennett
*Assistant Examiner*—Susanne C. Tinker
*Attorney, Agent, or Firm*—Birch, Stewart, Kolasch & Birch, LLP

[57] ABSTRACT

A cool air feeding system that senses a temperature of each part of a refrigerator compartment, compares the sensed temperature with a reference temperature, determines which part is to be cooled, and redistributes cool air to better cool a part of the refrigeration having a greater need to be cooled. Cool air redistribution is achieved using a single value having multiple openings. Such a valve can take the form of cylindrical manifold and a corresponding cylindrical, unitary-body flow distributor, for example.

4 Claims, 13 Drawing Sheets

COOL AIR FEEDING SYSTEM FOR REFRIGERATOR

BACKGROUND OF THE INVENTION

1. Field of the Invention

The present invention relates to a cool air feeding system for refrigerators and, more particularly, to a system which feeds cool air to a refrigerator compartment using a duct or the like.

2. Discussion of Related Art

As illustrated in FIG. 1, a conventional cool air feeding system for refrigerators has a duct 2 installed on the rear wall of a refrigerator compartment. The inner space of the refrigerator compartment is divided into top, intermediate and lowest sections a, b and c by shelves. The refrigerator compartment has a plurality of cool air exhaling openings 3 for exhaling cool air to the top, intermediate and lowest sections respectively.

When operating the refrigerator, the cool air inhaled into the duct 2 from the freezer compartment is fed to the refrigerator compartment through the cool air exhaling openings 3 all having the same shape and size. But, since the same quantity of cool air is always fed to each part of the refrigerator compartment, if the foods stored in each shelf are not distributed equally and the kind and temperature of foods are different one another, disproportion in temperature is generated.

More cool air should be fed into the parts storing more foods and/or high temperature foods than into the other parts. But, in the conventional refrigerator, only a given quantity of cool air is fed into each part so that the foods stored may be over-cooled or under-cooled.

As illustrated in FIGS. 2 and 3, the conventional cool air feeding system may have a fan(not shown) for forcibly ventilating cool air into the freezer compartment 21, a duct and a plurality of shelves 23 installed on the rear wall of the refrigerator compartment 22 to guide and feed cool air into the refrigerator compartment.

As illustrated in FIG. 3, the duct 24 has a cool air inlet 25 for inhaling cool air and a cool air exhaling openings 26 for exhaling the inhaled cool air to the refrigerator compartment. Cool air exhaling openings 26 are also installed on a control box 27 disposed on the front part of the duct to thereby communicate with the cool air exhaling openings of the duct.

Therefore, the cool air inhaled in the cool air inlet 25 of the duct 24 is exhaled through the cool air exhaling openings 26 to each shelf 23 installed in the refrigerator compartment 22 to thereby cool the foods put on the shelf.

But, since the cool air exhaling openings 26 for exhaling cool air into the refrigerator compartment 26 are always fixed on the predetermined positions, they result in disproportion in temperature on each shelf 23. The parts of each shelf 23 in the vicinity of the cool air exhaling openings 26 are over-cooled so that the foods stored therein may freeze. On the contrary, the parts far away from the cool air exhaling openings 26 are not cooled so that the foods stored therein may spoil.

Also, disproportion in the temperature distribution increases power consumption.

FIGS. 4 to 7 show another example of the conventional cool air feeding system. The cool air feeding system, different from the one illustrated in FIGS. 1 to 3, extends into the lower side of the shelf. FIG. 4 is a front view of the refrigerator. As illustrated in FIG. 4, the reference numeral

31 designates a main body, 32 a freezer compartment, 33 a refrigerator compartment, 34 a vegetable box, 35 a freezer compartment door and 36 a refrigerator compartment door. As illustrated in FIGS. 6 and 7, the cool air feeding system includes a duct 41 installed on the rear of the refrigerator compartment 33, a plurality of cool air exhaling openings 41*a* formed on the duct, the cool air exhaling openings being spaced apart from one another, guide grooves 33*a* each formed on the inner side walls of the refrigerator compartment 33, and shelves 42 slidably combined with the guide grooves to distribute the cool air exhaled through the cool air exhaling openings 41*a* into the refrigerator compartment 33. Multi-story shelves 42 are displacably installed in the refrigerator compartment 33.

The shelf 42 includes a base 43 formed like a plate to support the stores on its upper surface, a duct 44 fixed on the central portion of the lower surface of the base 43 back and forth, a plurality of cool air exhaling openings 44*a* formed on the lower and lateral sides of the duct 44, and a cool air inhaling guide 45 formed on the rear end of the duct 44 to be thereby connected to the cool air exhaling openings 41*a* of the shelf 42. The duct 44 is fixed on the base 43 using the methods of adhering, interference fitting and high-frequency welding.

Therefore, when the shelf is pushed into the guide groove 43*a* formed on the inner lateral sides of the refrigerator compartment 33, the cool air inhaling guide 45 of the shelf 42 is connected to the cool air exhaling openings 41*a* of the duct 41. The cool air descended along the duct 41 is inhaled into the duct 44 through the cool air inhaling guide 45 of the shelf 42. The cool air inhaled moves along the duct 44 and exhales through the cool air exhaling openings 44*a* formed on the lower and lateral sides of the duct 44.

However, since the cool air feeding system like above has a structure that the duct 44 is fixed on the central portion of the lower surface of the shelf 42, the exhaling direction of the cool air towards the cool air exhaling openings 44*a* is limited. As a result, the foods stored in the edge of the refrigerator compartment or in the door can not be effectively cooled.

SUMMARY OF THE INVENTION

Accordingly, the present invention is directed to a cool air feeding system which substantially obviates one or more of the problems due to limitations and disadvantages of the related art.

An object of the present invention is to provide a cool air feeding system which uniformly cools the foods irrespective of the kind and position of foods stored in the refrigerator compartment by varying the exhaling roads of the cool air.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the cool air feeding system includes means for sensing temperature of each part of the refrigerator compartment, means for comparing the temperature sensed by the temperature sensing means with a reference temperature to thereby discriminate which part to be cooled, and moving the cool air exhaling position to the part to be cooled.

For example, the exhaling position moving means includes a duct cover installed on the rear wall of the refrigerator compartment and having a plurality of cool air exhaling openings for exhaling cool air to each part of the refrigerator compartment divided by shelves, a duct installed on the rear of the duct cover and having multi-story cool air exhaling openings communicating with the cool air exhaling openings formed on its peripheral surface in plural columns, and a rotation driving means making one column of cool air exhaling openings coincide with the cool air outlet by rotating the duct in accordance with a signal of the comparing and discriminating means.

As another example, the exhaling position moving means includes a duct installed on the rear wall of the refrigerator compartment and having a plurality of vertically elongated hollows formed on its frond part facing the refrigerator compartment, a duct cover rotatably installed around the outer circumference of the duct and having a plurality of slantly elongated hollows for forming the movable cool air exhaling openings by overlapping with the vertical elongated hollows, and a driving means for rotatably driving the duct cover.

As still another example, the exhaling position moving means includes a shelf formed like a plate to support the foods on its upper part, a duct supported to the lower surface of the shelf, the duct being capable of rotating by the rotating means, and a cool air inhaling guide installed on the central portion of the rear of the shelf to guide cool air to the inside of the duct.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

Figure 11:
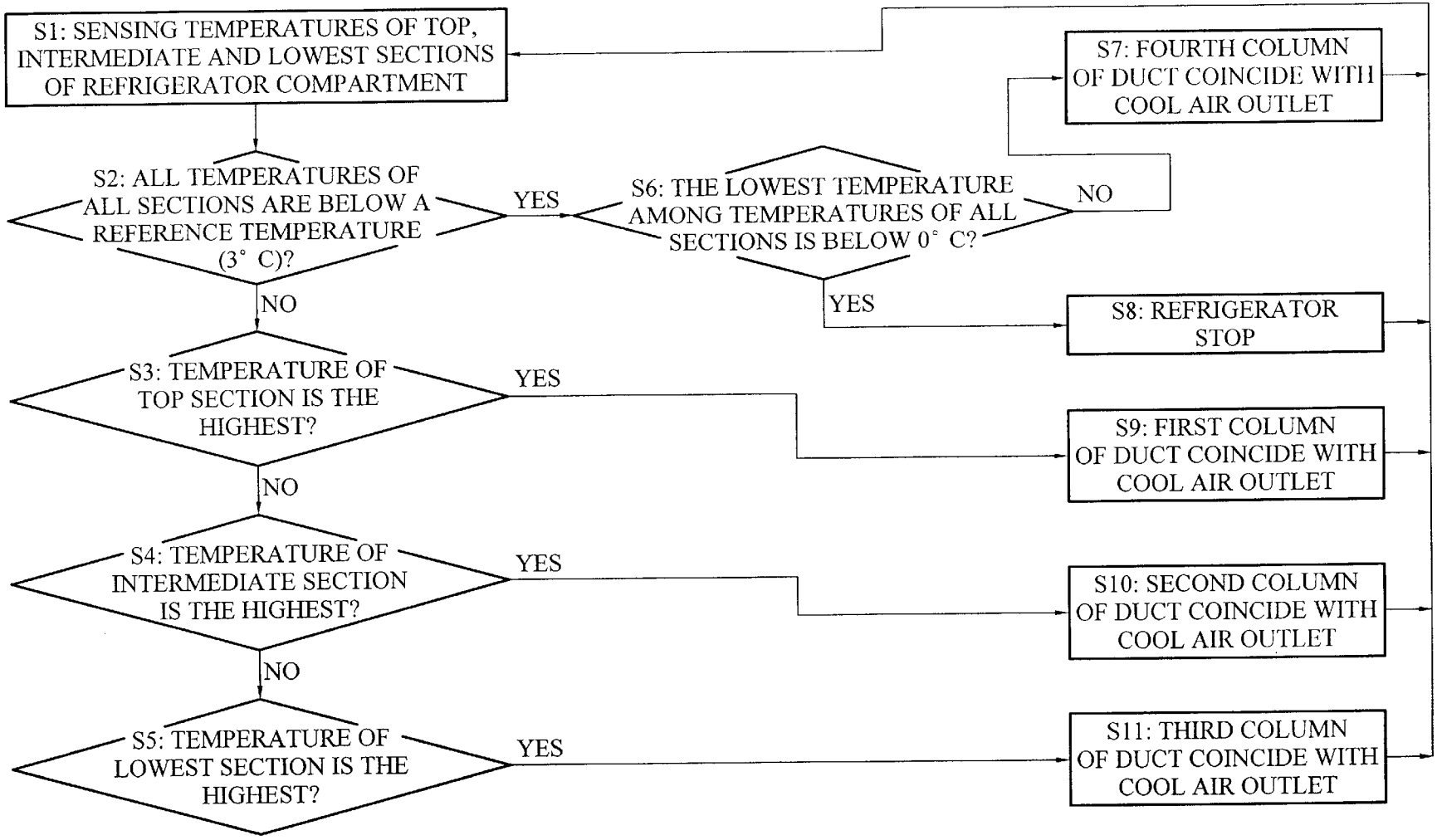
Figure 12:
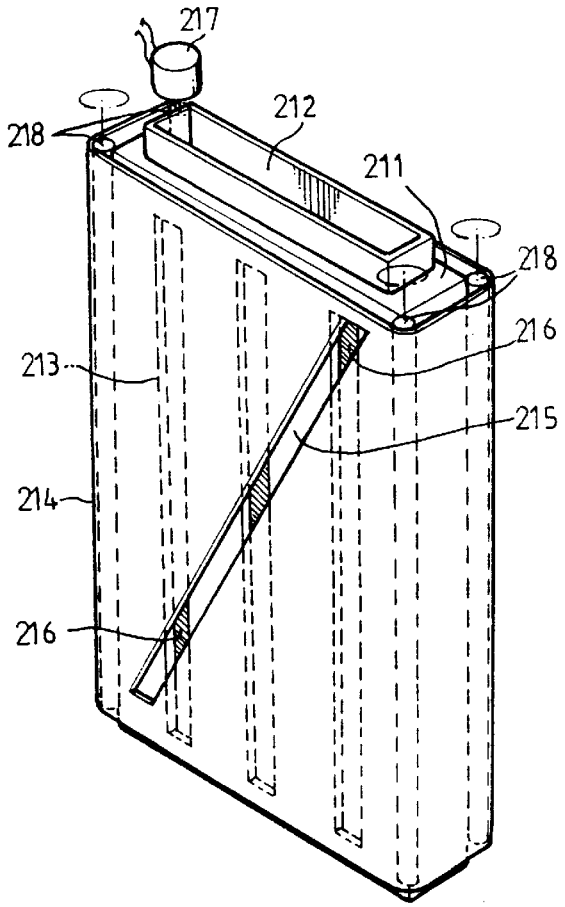
Figure 13:
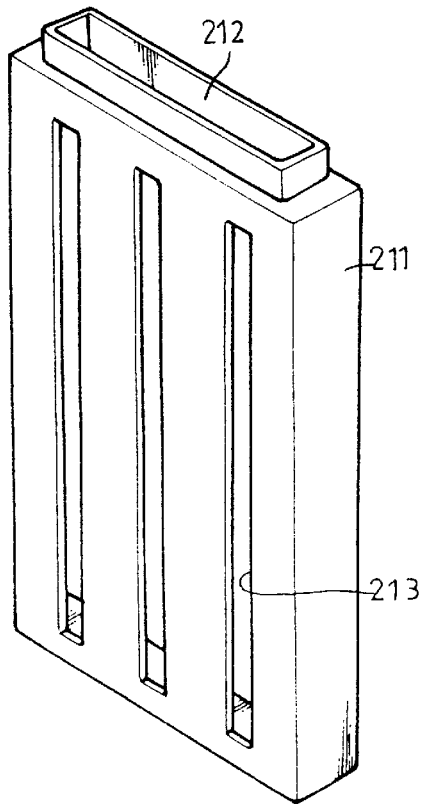
Figure 14:
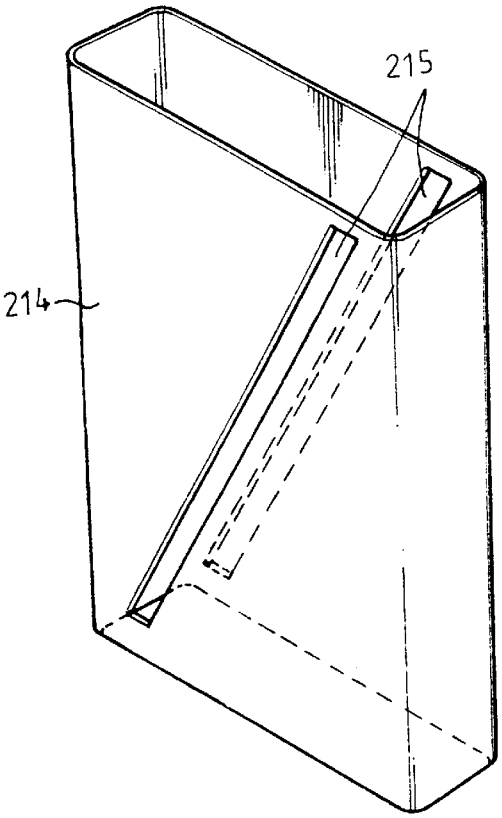
Figure 15:
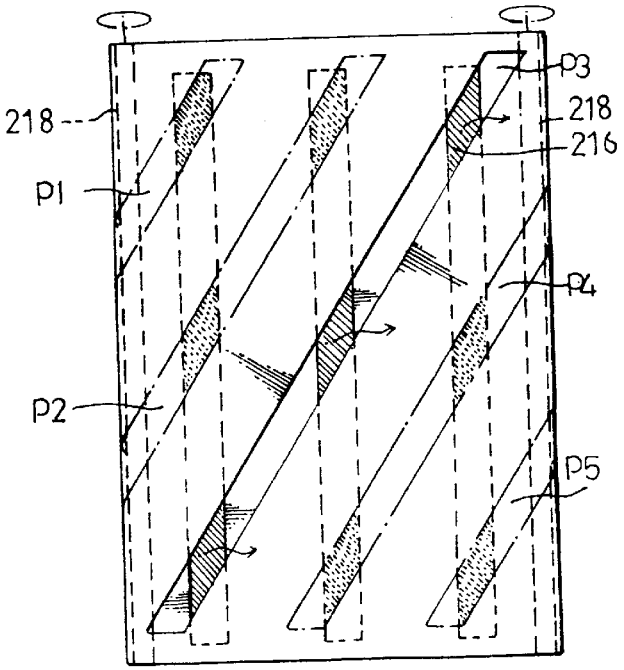
Figure 16:
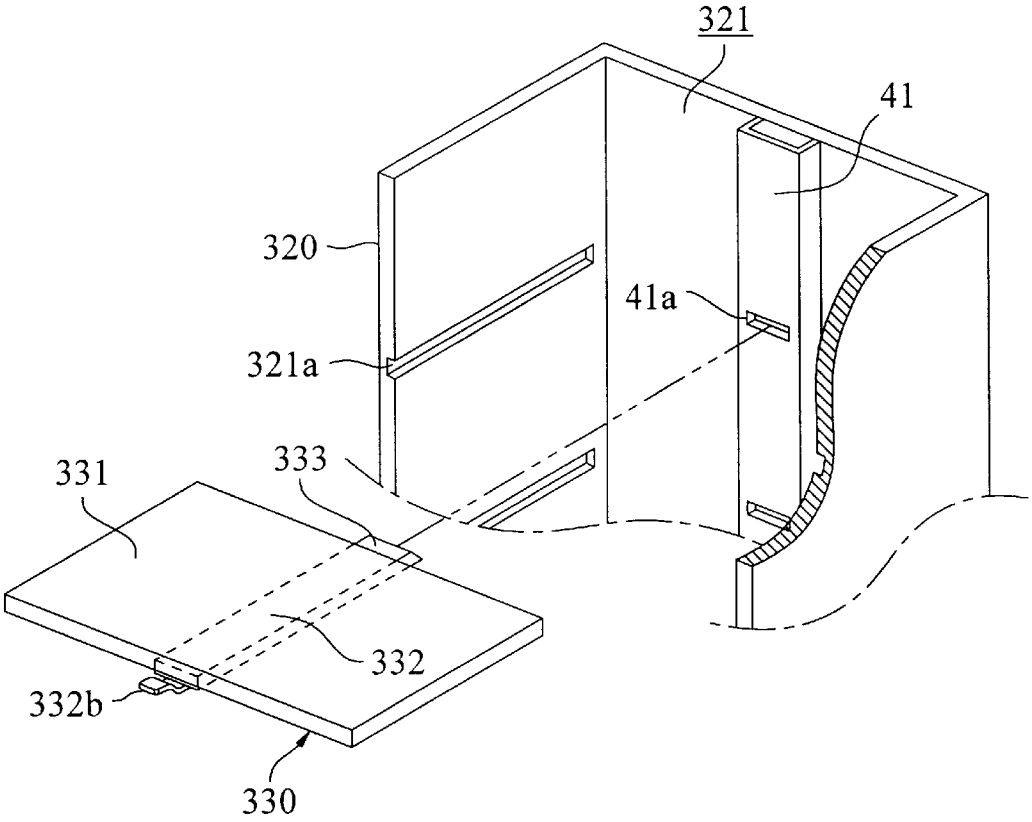
Figure 17:
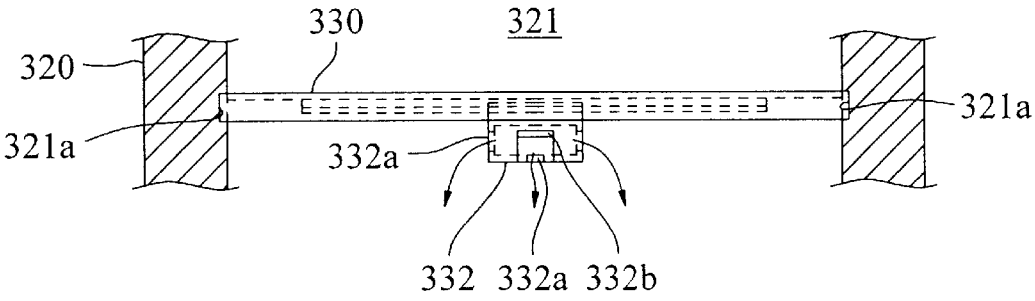
Figure 18:
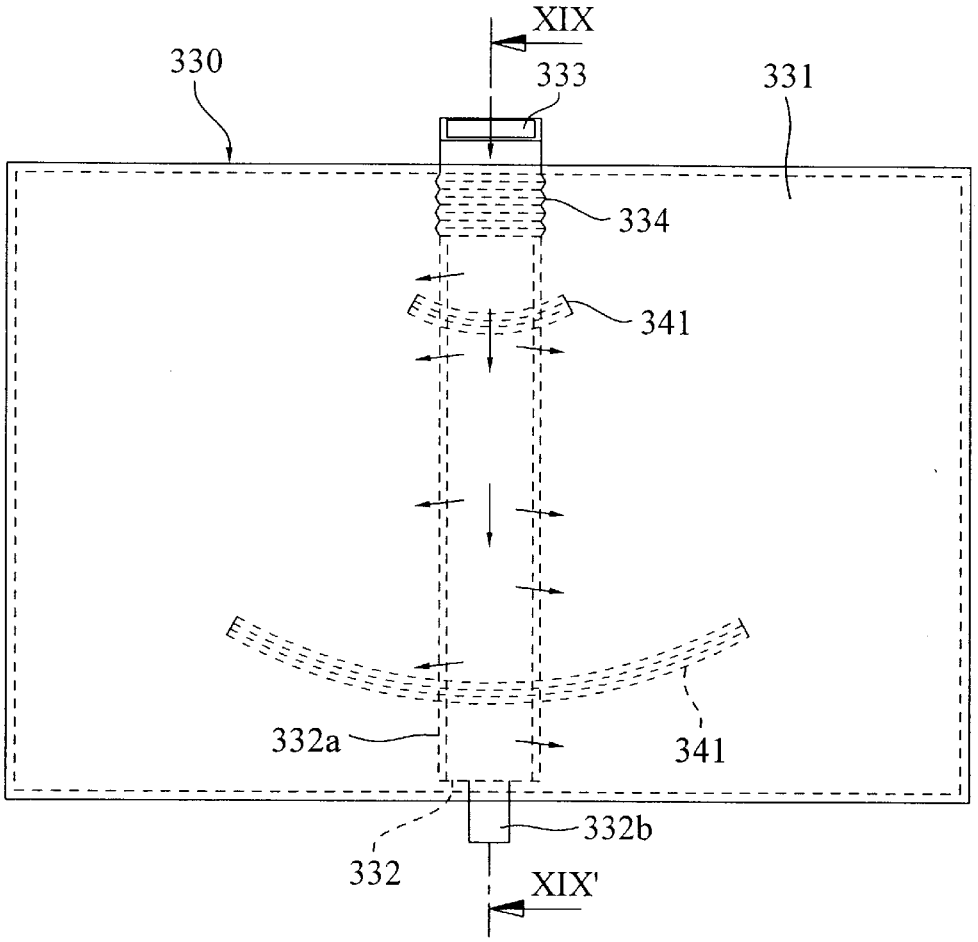
Figure 19:
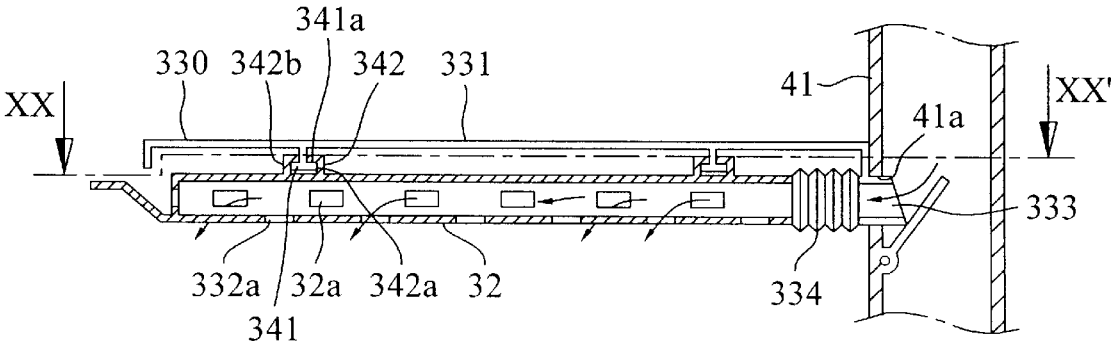
Figure 20:
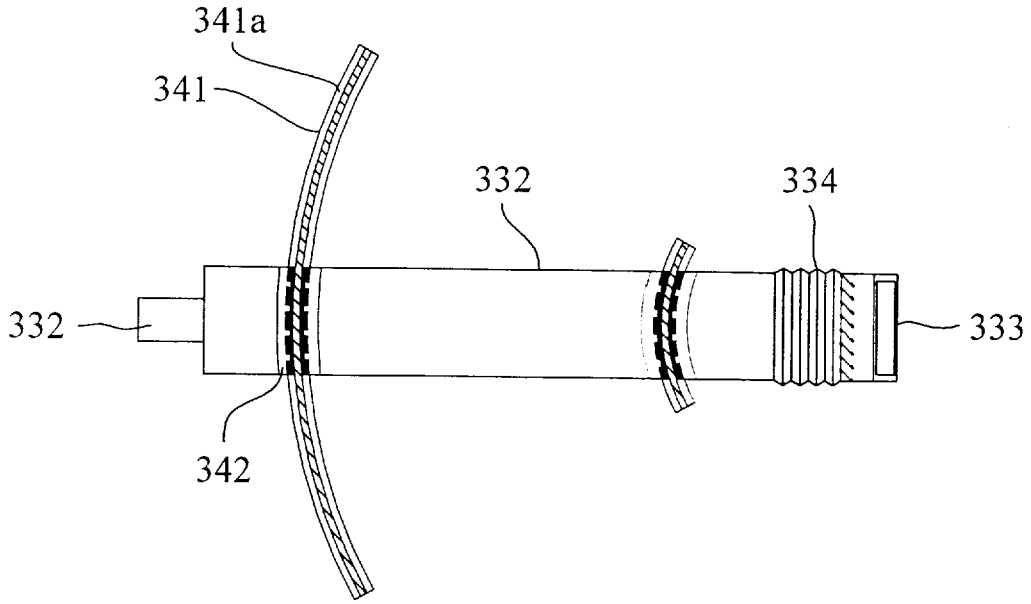
Figure 21:
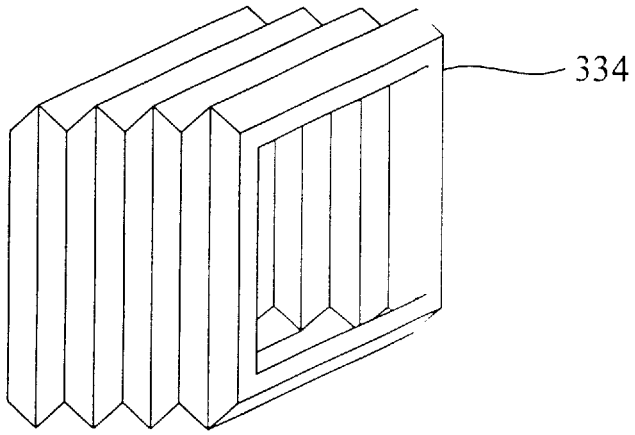
Figure 22:
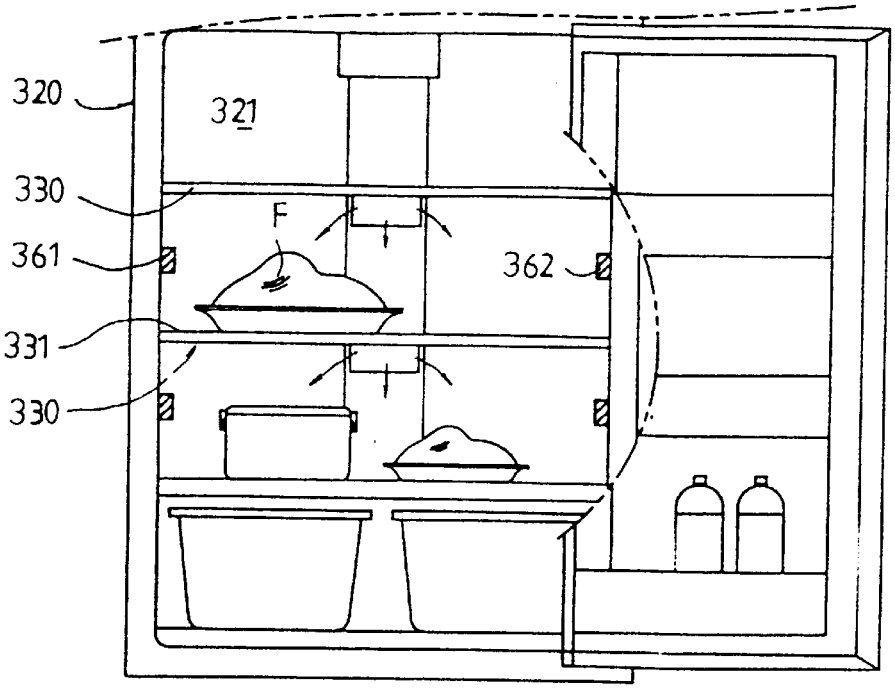
Figure 23:
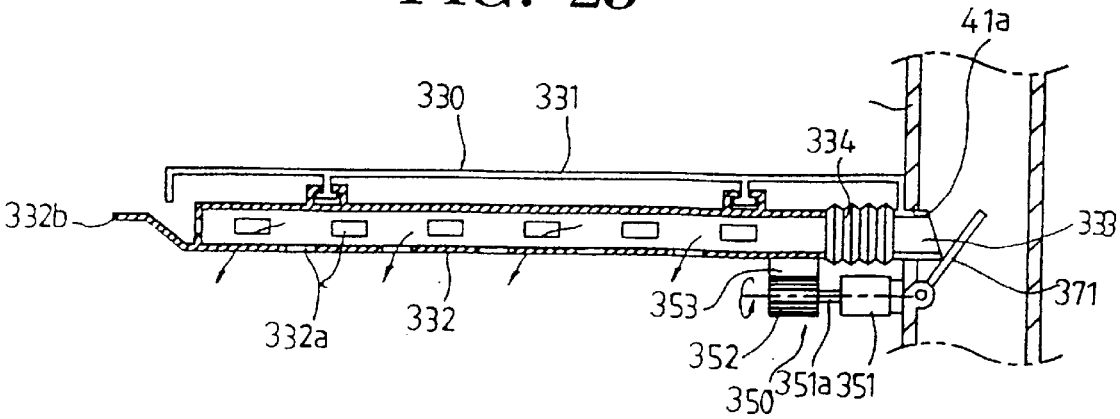

FIGS. 10*a*–10*d* are views exemplifying the duct having the four-column cool air exhaling openings;

FIG. 11 is a flow chart illustrating the inner temperature controlling processes according to the first preferred embodiment of the present invention;

FIG. 12 is a perspective view illustrating a duct according to a second preferred embodiment of the present invention;

FIG. 13 is another perspective view of the duct of FIG. 12;

FIG. 14 is a perspective view of a duct cover according to the second preferred embodiment of the present invention;

FIG. 15 is a front view illustrating positions of the cool air exhaling openings varied in accordance with the rotation of the duct cover;

FIG. 16 is a exploded perspective view of a cool air feeding system according to a third preferred embodiment of the present invention;

FIG. 17 is a front view of the cool air feeding system according to the third preferred embodiment of the present invention;

FIG. 18 is a plan view of the cool air feeding system according to the third preferred embodiment of the present invention;

FIG. 19 is a cross-sectional view along the line C—C of FIG. 18;

FIG. 20 is a cross-sectional view along the line D—D of FIG. 19;

FIG. 21 is a perspective view of a connecting member of the cool air feeding system according to the third preferred embodiment of the present invention;

FIG. 22 is a front view illustrating an exemplary automatic operation of the third preferred embodiment of the present invention; and FIG. 23 is a cross-sectional view of FIG. 22.

DETAILED DESCRIPTION OF PREFERRED EMBODIMENT

Reference will now be made in detail to the preferred embodiments of the present invention, examples of which are illustrated in the accompanying drawings.

Figure 8:
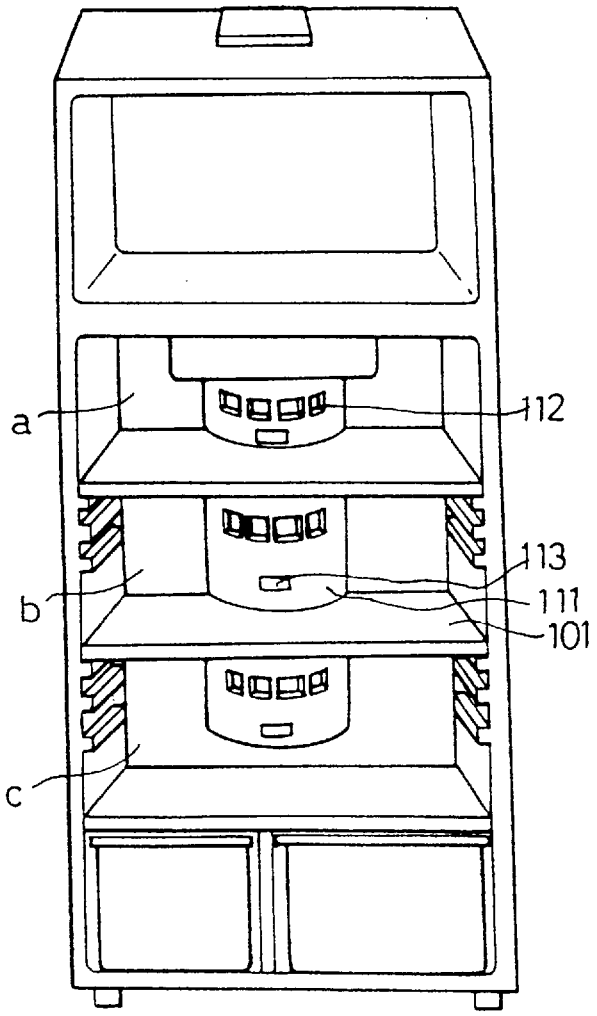
FIG. 8 is a perspective view of a refrigerator according to a first preferred embodiment of the present invention.

As illustrated in FIG. 8, a duct cover 111 is installed on the rear wall of the refrigerator compartment. The duct cover 111 exhales cool air into each section(upper, middle and lower sections). The duct cover 111 is provided with a plurality of cool air outlets 112 for exhaling cool air and a plurality of temperature sensors 113 for sensing the temperature in each section.

Figure 9:
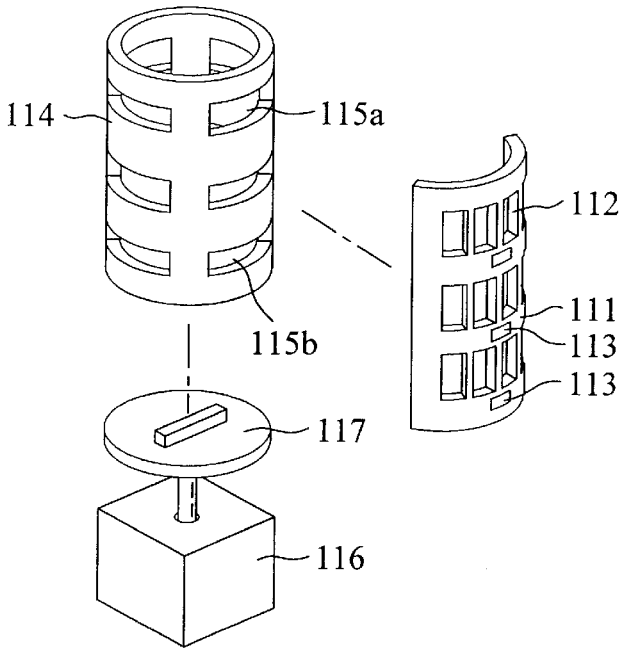
FIG. 9 is a exploded perspective view of a duct of FIG. 8.

As illustrated in FIG. 9, a cylindrical duct 114 (or unitary-body flow distributor) is longitudinally installed in the rear of the duct cover 111. A plurality of cool air exhaling openings 115*a* and 115*b* are installed on the peripheral surface of the duct 114. The duct comes into close contact with the duct cover such that air can only pass through those openings of the duct 114 that face the duct cover 111. The duct cover 111 and the housing (not depicted) within which the duct 114 is located together act as a manifold.

Also, the cool air exhaling openings 115*a* (relatively larger) and 115*b* (relatively smaller) are formed at positions corresponding to, and in communication with, each set of cool air outlets 112 formed on the duct cover 111, and arranged in plural columns upward and downward. The larger cool air exhaling opening 115*a* and the smaller cool air exhaling opening 115*b* are compositely arranged on each column. The duct 114 is fixed on a rotating plate 17 being capable of rotating with the power generated from a motor 116. The duct 114 rotates together with the rotation of the rotating plate 17. The motor begins driving with the signal of central processing unit (CPU) of the temperature sensor.

Figure 10A:
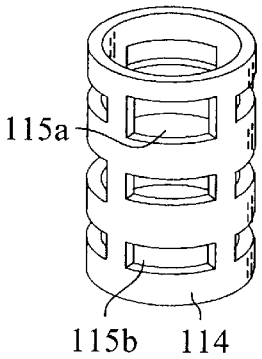
Figure 10C:
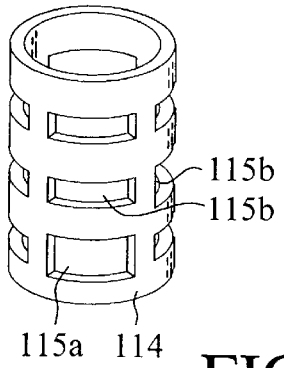
Figure 10B:
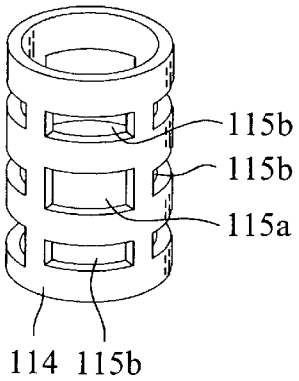
Figure 10D:
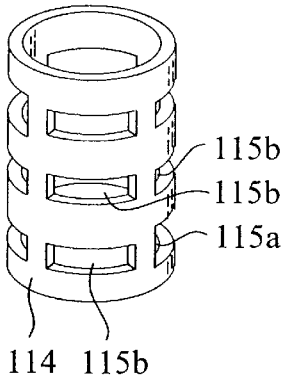

FIGS. 10A to 10D each illustrate a first column of cool air exhaling openings up to a fourth column of cool air exhaling openings. As shown in FIG. 10A, the top cool air exhaling opening 115*a* of the duct 114 is larger while the intermediate and lowest openings 115*b* are smaller. As shown in FIG. 10B, the intermediate cool air exhaling opening 115*a* is larger while the top and lowest openings 115*b* are smaller. As shown in FIG. 10C, the lowest cool air exhaling opening 115*a* is larger while the top and intermediate cool air exhaling openings 115*b* are smaller. As shown in FIG. 10D, only the smaller cool air exhaling openings are formed on the duct.

As described above, when the first column of cool air exhaling openings (FIG. 10*a*) coincide with the cool air outlet 112 of the duct cover 111, a large quantity of cool air is exhaled to the top section a of the refrigerator compartment. In comparison with that, when the second column of cool air exhaling openings coincide with the cool air outlet 112, a large quantity of cool air is exhaled to the intermediate section b. In addition, when the third column of cool air exhaling openings (FIG. 10*c*) coincide with the cool air outlet, a large quantity of cool air is exhaled to the lowest section c. Furthermore, when the fourth column of cool air exhaling openings (FIG. 10*d*) coincide with the cool air outlet, only a small quantity of cool air is exhaled to all sections of the refrigerator compartment.

In operation, as illustrated in FIG. 11, when the temperatures in each section sensed by the temperature sensor are all below a reference temperature and the temperature in one section is below zero, operation of the refrigerator is stopped (S1, S2, S6, S8). But, when the temperatures in each section are all below the reference one and the lowest temperature of section is over zero, the motor 116 begins driving to make the fourth column of cool air exhaling openings formed on the duct 111 coincide with the cool air outlet 12 of the duct cover 11 (S1, S2, S6, S7). At this time, since the fourth column of cool air exhaling openings are all smaller, a small quantity of cool air is exhaled to the refrigerator compartment.

However, when the temperatures of each section of the refrigerator compartment sensed by the temperature sensor are all over the reference one, the sensor discriminates a highest temperature of section and thereby issues a signal to drive the motor 116. When the temperature of the top section a is the highest one, operation of the motor makes the first column of cool air exhaling openings coincide with the cool air outlet so that a large quantity of cool air is exhaled only to the top section (S1, S2, S3, S9). When the temperature in the intermediate section b is the highest one, the second column of cool air exhaling openings coincide with the cool air outlet so that a large quantity of cool air is exhaled only to the intermediate section (S1, S2, S3, S4, S10). When the temperature in the lowest section c is the highest one, the third column of cool air exhaling openings coincide with the cool air outlet so that a large quantity of cool air is exhaled only to the lowest section (S1, S2, S3, S4, S5, S11). After all, the inner temperature of the refrigerator is uniformly kept throughout the total sections.

As illustrated in FIG. 12, a cool air feeding system according to a second preferred embodiment of the present invention includes a duct 211 installed on the rear wall of the refrigerator compartment, a duct cover 214 rotatably installed on the outer circumference of the duct, and means for driving the duct cover to be rotated around the circumference of the duct.

Figure 1:
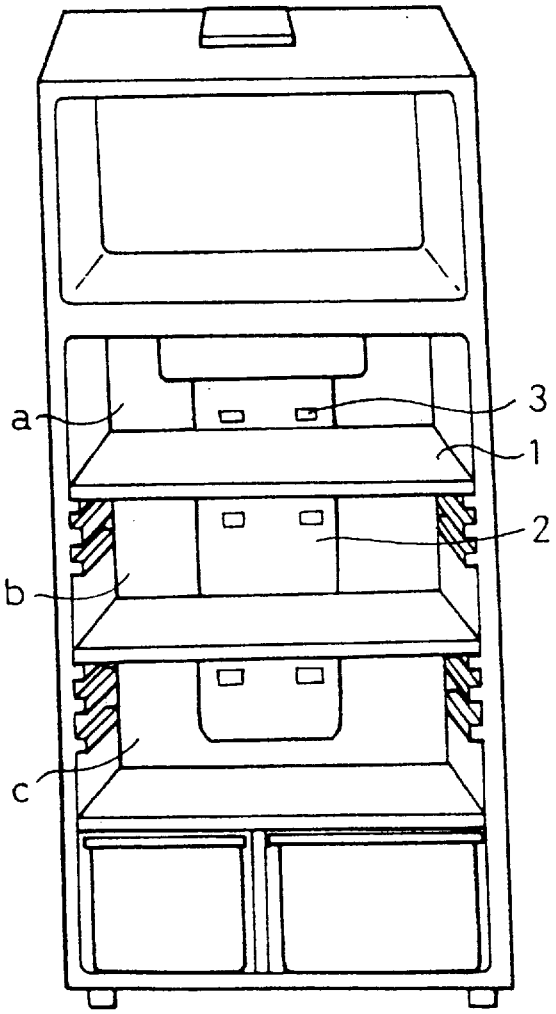
FIG. 1 PRIOR ART
FIG. 1 illustrates a conventional cool air feeding system fixed on the wall of a refrigerator compartment.
Figure 2:
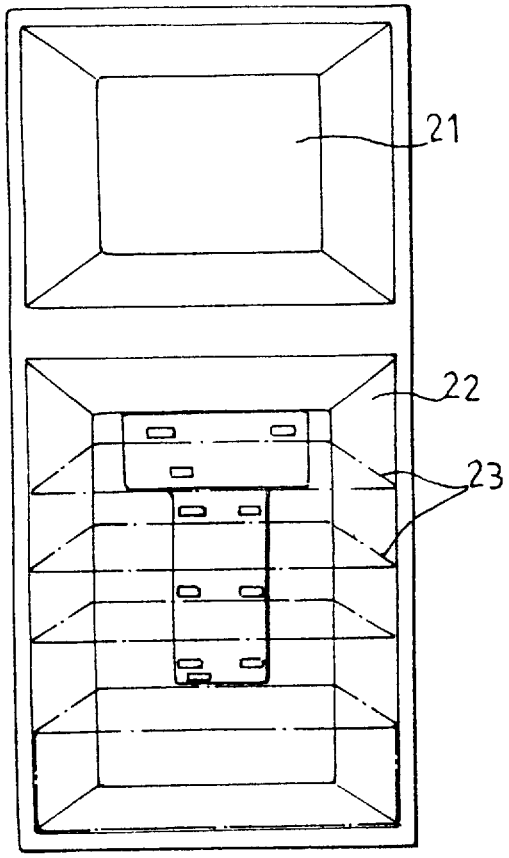
FIG. 2 PRIOR ART
FIG. 2 illustrates another conventional cool air feeding system fixed on the wall of the refrigerator compartment.
Figure 3:
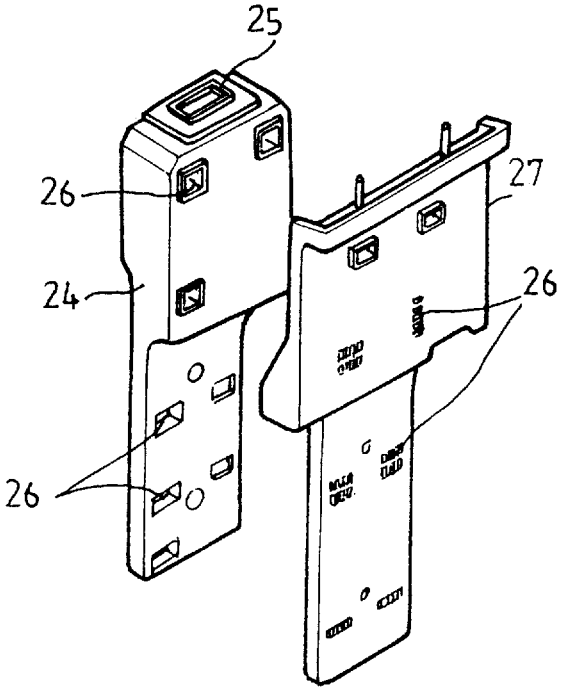
FIG. 3 PRIOR ART
FIG. 3 is a perspective view of a duct of FIG. 2.
Figure 4:
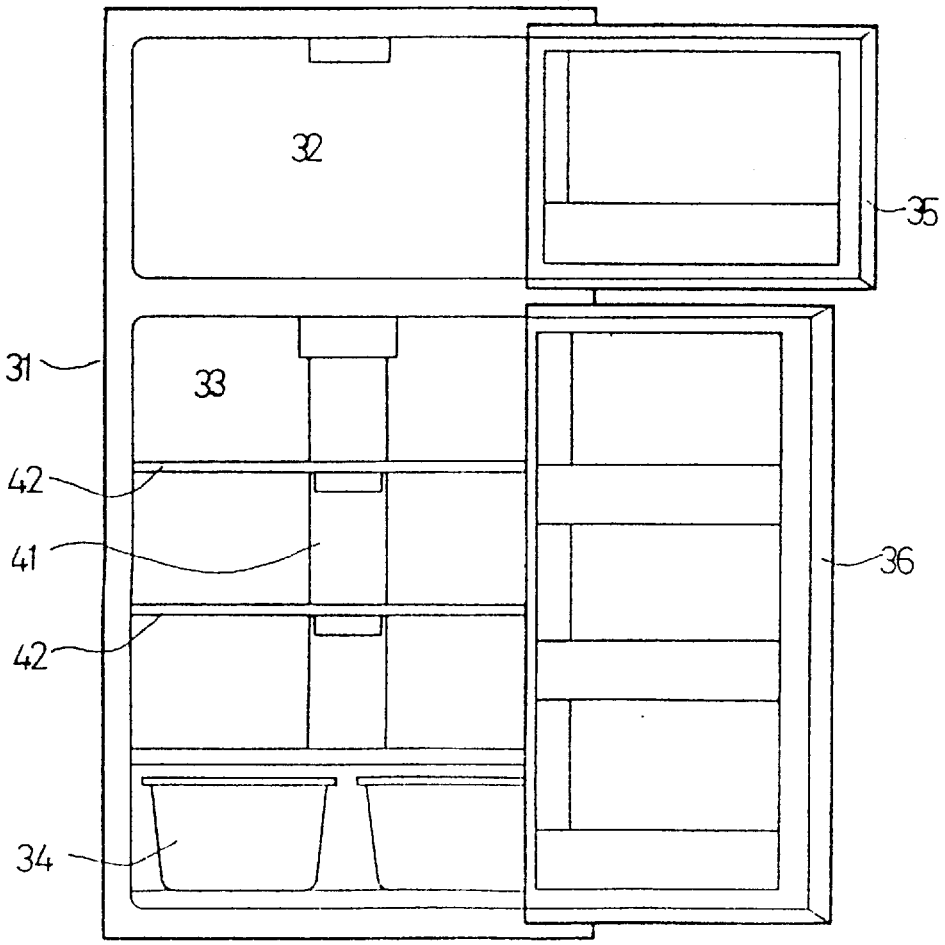
FIG. 4 PRIOR ART
FIG. 4 is a front view of the refrigerator having the cool air feeding system.
Figure 5:
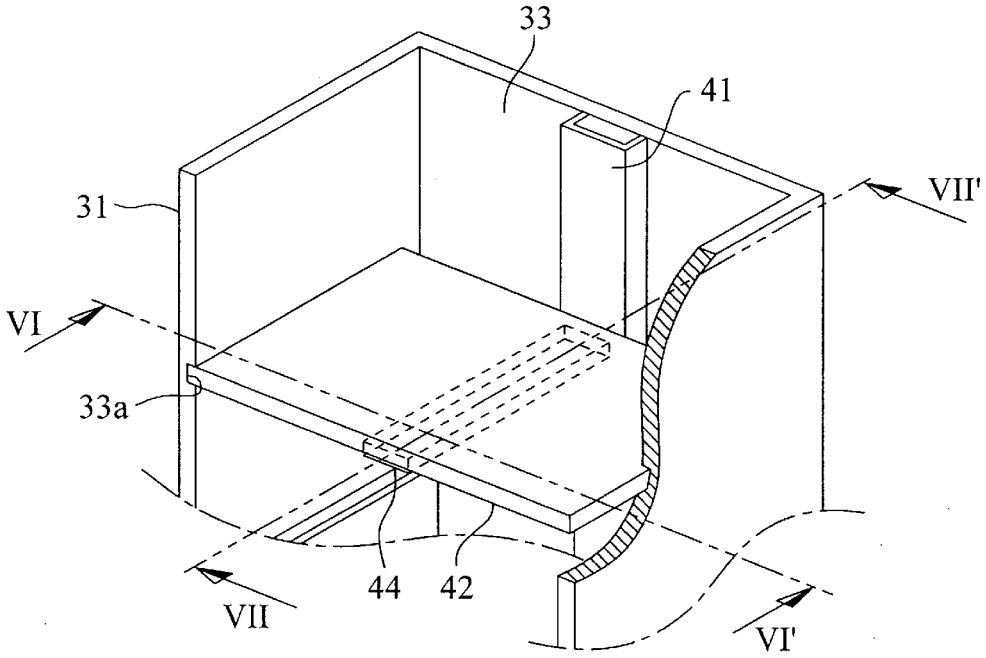
FIG. 5 PRIOR ART
FIG. 5 is a perspective view of the conventional cool air feeding system.
Figure 6:
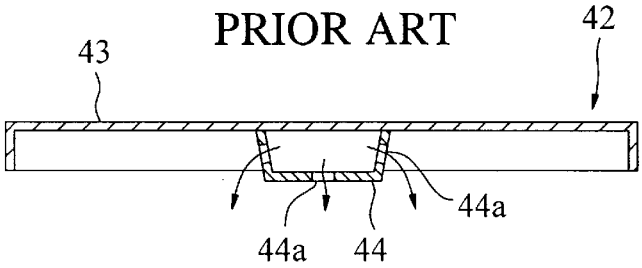
FIG. 6 PRIOR ART
FIG. 6 is a cross-sectional view along the line A—A of FIG. 5.
Figure 7:
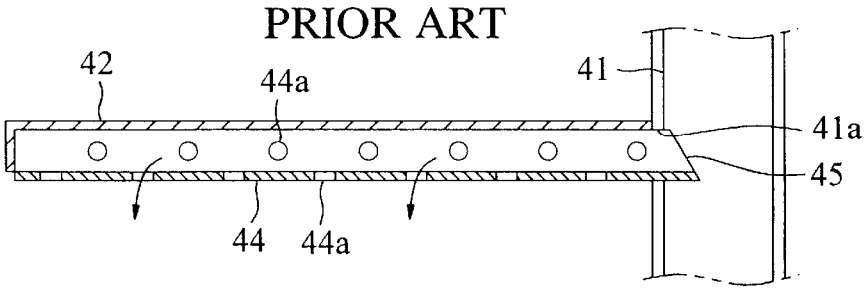
FIG. 7 PRIOR ART
FIG. 7 is a cross-sectional view along the line B—B of FIG. 5.

As illustrated in FIG. 13, the duct 211 has a form of rectangular bucket. It has an upper end forming a cool air inhaling opening 212 and a front wall forming a plurality of vertically elongated hollows 213. A duct cover 214 installed on the outer circumference of the duct 211, like the one shown in FIG. 5, covers the entire circumference of the duct, and has a plurality of slantly elongated hollows (or openings) 215 diagonally formed centering around the duct.

The duct cover 214 covering the duct 211 is composed of a flexible soft material to be thereby freely rotate around the duct in a position coming into close contact with the front wall of the duct. Therefore, the vertically elongated hollows 213 formed on the front wall are isolated by the duct cover 214 except for the parts overlapped with the slantly elongated hollow (or openings) 215 of the duct cover 214. Also, cool air exhaling openings 216 are formed where the vertically elongated hollows 213 are overlapped with the slantly elongated hollow 215 (deviant creased line illustrated in FIGS. 12 and 15).

The driving means, as illustrated in FIG. 12, includes a driving motor 217 capable of rotating in a normal and reverse direction and a plurality of pulleys 218 rotated by the driving motor. The duct cover 214 is wound collectively around the pulleys 218 and rotates along the rotating direction of the pulley.

As described above, in the cool air feeding system according to the second preferred embodiment of the present invention, the pulley 218 and the duct cover 214 are rotated in accordance with operation of the motor 217. The positions of the cool air exhaling openings 216 are continuously varied with the rotation of the duct cover 214. That is, when the duct cover 214 rotates around the duct 211 with operation of the motor 217, the position of the slantly elongated hollow 215 formed on the duct cover 214 is continuously varied. Thus, the positions of the cool air exhaling openings 216 in which the vertically elongated hollows 213 are overlapped with the slantly elongated hollow 215 are also continuously varied.

As illustrated in FIG. 15, when the slantly elongated hollow 215 is placed in a first position, the slantly elongated hollow 215 and the vertically elongated hollow 213 are overlapped only on the upper end of the duct 211 to thereby form a cool air exhaling opening. Also, as the slantly elongated hollow 215 moves from the second position to the fifth position, the position and number of the cool air exhaling openings, formed by overlapping the slantly elongated hollow 215 with the vertically elongated hollows 213, are varied.

As illustrated in FIGS. 16 to 23, a cool air feeding system according to a third preferred embodiment of the present invention includes a shelf 331 slidably connected to guide grooves 321*a* formed on the inner side walls of the refrigerator compartment 321 of the main body 320 to thereby support the stores, a shelf duct 332 having a plurality of cool air exhaling openings 332*a* formed on its lower and lateral sides and the shelf duct placed beneath the lower side of the shelf 331 to be thereby rotated by the rotating means, and a cool air inhaling guide 333 provided on the central portion of the rear of the shelf 331 and connected to the cool air exhaling openings 311*a* of the refrigerator compartment duct 311 to thereby guide the cool air into the inner side of the shelf duct 332.

The rotating means includes guide rails 341 each formed on the central portion of the bottom of the shelf 331 before and behind and having a stop projection 341*a* on its lower part, a rotation guide grooves 342*a* each formed on the upper, front and rear parts of the shelf duct 332 to thereby cover the guide rail 341, and a circular arc of rotation support ribs 342 each having a stop projection 342*b*.

A knob 332*b* for easily rotating the shelf duct is formed on the front end of the shelf duct 332. The knob is used when the shelf duct is manually controlled. A connecting member 334 having a corrugated form is interposed between the cool air inhaling guide 333 and the shelf duct 332 to support the rotating motion of the shelf duct as well as prevent the cool air from being leaked. The cool air inhaling guide is the lower side of the shelf 331, i.e., the shelf duct 332 is never separated from the shelf. Also, since the connecting member 334 having a corrugated tube form is interposed between the cool air inhaling guide 333, formed on the central portion of the rear of the shelf 331, and the shelf duct 332, the rotating motion of the shelf duct 332 is supported as well as the cool air is prevented from being leaked.

FIGS. 22 and 23 illustrate another example for automatically operating the cool air feeding system according to the third preferred embodiment of the present invention. For that purpose, the cool air feeding system shown in the example includes a driving motor 351 fixed on the rear wall of the refrigerator compartment, a driving gear 352 fixed to the rotation shaft of the driving motor, and a driven gear 353 formed on the bottom of the shelf duct 331 and engaged with the driving gear 352. Reference numerals 361 and 362 designate part of temperature sensors attached to the wall of the refrigerator compartment.

In operation, when the foods are not put in the shelf 330 of the refrigerator compartment, a difference in temperature around the temperature sensors (installed on the inner lateral sides of the refrigerator compartment 321) does not occurred, and thus any signal issued from the temperature sensor is not transmitted to the driving means 350. As a result, the rotating motion of the shelf duct 332 does not occur.

As illustrated in FIG. 22, when the food F is put in the upper left part 331 of the shelf 330, the temperature around the food F rises. Thus, the temperature sensor 361 installed on the left side wall of the refrigerator compartment 321 senses the temperature rising. At this time, the temperature sensed by the temperature sensor 361 installed on the left side wall of the refrigerator compartment and the one sensed by the temperature sensor 362 installed on the right side wall differ from each other. Thus, the comparing and discriminating means acknowledges the temperature difference to thereby operate the driving means 350. That is, the power generated from the driving motor 351 is transmitted through the driving gear 352 fixed to the rotation shaft 351*a* to the driven gear 353. Then, the shelf duct 332 integrated with the driven gear 353 rotates toward the foods F stored on the left side so that the cool air exhales only to the foods F through the cool air exhaling openings 332*a* of the shelf duct 332.

Thereafter, after the food F newly stored in the refrigerator compartment has been locally cooled so that the temperature distribution in the corresponding section is stabilized, the shelf duct returns to the central portion with respect to the shelf 331.

As described above, since the inventive cool air exhaling opening is not fixed but continuously varied in its position, the cool air is uniformly distributed on each part of the shelf so that power consumption caused by over-cooling and the like can be reduced.

It will be apparent to those skilled in the art that various modifications and variations can be made to the present invention without departing from the spirit or scope of the invention. Thus, it is intended that the present invention cover the modifications and variations of this invention provided they come within the scope of the appended claims and their equivalents.

What is claimed is:

1. A cool air feeding system for a refrigerator having a plurality of chambers, the system comprising:

means for sensing temperatures in said chambers, respectively, of said refrigerator;

an air flow assembly for distributing individualized amounts of air to said chambers, said assembly including a duct cover installed on the rear wall of an interior space of the refrigerator in which said chambers are formed, said duct cover having multiple outlets corresponding to said chambers, a duct installed against the rear of the duct cover and having multiple openings formed on a peripheral surface thereof in plural columns, and rotation driving means for rotating the duct in accordance with a signal of a controller to make a predetermined one of said columns of openings coincide with the outlets of the duct cover; and said controller for comparing the sensed temperatures with a reference temperature, for determining individual cooling needs of said compartments, and for controlling said air flow assembly according to said individualized needs.

2. The cool air feeding system as claimed in claim 1, wherein the openings formed on the duct include large openings and small openings.

3. The cool air feeding system as claimed in claim 1, wherein said refrigerator has a top, an intermediate and a lowest chamber and said columns of openings comprise:

a first column of openings for which a top opening is large while intermediate and lowest openings are small;

a second column of openings for which an intermediate opening is large while top and lowest openings are small;

a third column of openings among which a lowest opening is large while top and intermediate openings are small; and a fourth column of openings all of which are small.

4. The cool air feeding system as claimed in claim 1, wherein the rotation driving means comprises:

a motor driven in accordance with the control means; and a rotating plate rotated by power generated from the motor and fixed to the duct.

* * * * *